US005397507A

United States Patent [19]

Bauer et al.

[11] Patent Number: 5,397,507

[45] Date of Patent: Mar. 14, 1995

[54] PROCESS FOR THE PRODUCTION OF WASHING- AND CLEANING-ACTIVE GRANULES

[75] Inventors: Volker Bauer; Wilfried Raehse; Andreas Syldath, all of Duesseldorf; Ditmar Kischkel, Monheim, all of Germany

[73] Assignee: Henkel Kommanditgesellschaft auf Aktien, Duesseldorf, Germany

[21] Appl. No.: 978,701

[22] PCT Filed: Jul. 25, 1991

[86] PCT No.: PCT/EP91/01395

§ 371 Date: Feb. 3, 1993

§ 102(e) Date: Feb. 3, 1993

[87] PCT Pub. No.: WO92/02609

PCT Pub. Date: Feb. 20, 1992

[30] Foreign Application Priority Data

Aug. 3, 1990 [DE] Germany ..... 40 24 657.4

[51] Int. Cl.[6] ..... C11D 1/20; C11D 1/722

[52] U.S. Cl. ..... 252/549; 252/550; 252/551; 252/174.21; 252/174.25; 252/174.17

[58] Field of Search ..... 252/549, 550, 551, 174.21, 252/174.25, 174.17

[56] References Cited

U.S. PATENT DOCUMENTS

| | | | |
|---|---|---|---|
| 3,915,903 | 10/1975 | Wise | 252/552 |
| 4,384,978 | 5/1983 | Ploog et al. | 252/353 |
| 4,482,470 | 11/1984 | Reuter | 252/162 |
| 4,495,092 | 1/1985 | Schmid et al. | 252/559 |
| 4,698,174 | 10/1987 | Denzinger | 252/174.24 |
| 4,820,448 | 4/1989 | Wegener et al. | 252/533 |
| 4,929,380 | 5/1990 | Schulz et al. | 252/121 |

FOREIGN PATENT DOCUMENTS

| | | |
|---|---|---|
| 0084154 | 7/1983 | European Pat. Off. . |
| 0116905 | 8/1984 | European Pat. Off. . |
| 0342917 | 11/1989 | European Pat. Off. . |
| 0342947 | 11/1989 | European Pat. Off. . |
| 9003977 | 4/1990 | WIPO . |

*Primary Examiner*—Linda Skaling
*Assistant Examiner*—K. Fries
*Attorney, Agent, or Firm*—Wayne C. Jaeschke; John E. Drach; Henry E. Millson, Jr.

[57] ABSTRACT

The invention concerns a method of converting aqueous surfactant mixtures, in particular aqueous pastes of surfactants with washing properties such as fatty-alcohol sulphates, in particular tallow alcohol sulphates and/or $C_{12}$–$C_{18}$ fatty-alcohol sulphates, monosalts of sulphonic fatty-acid methyl esters and their di-salts, alkylglusoside compounds, etc., into concentrated granular material with a long shelf life by granulation. The aqueous surfactant mixture, which includes as a viscosity-control agent alkoxylates of mono- and/or polyhydric alcohols with 8–40 carbon atoms which have up to 20 ethylene oxide and/or propylene oxide groups, is granulated together with fine-particulate water-soluble and/or water-insoluble solids compatible with washing and/or cleaning agents to give a free-running compound. At least part of the water content of the granular material thus produced is preferably then removed by drying, in particular in a fluidized bed.

15 Claims, No Drawings

PROCESS FOR THE PRODUCTION OF WASHING- AND CLEANING-ACTIVE GRANULES

BACKGROUND OF THE INVENTION

This invention relates to a process for converting water-containing preparations of washing- and cleaning-active surfactant compounds into storable surfactant granules and into storable detergents in granular form.

Considerable and, at the same time, greatly increasing interest is being shown in the use of oleochemical surfactant compounds in detergents and cleaning products. The primary considerations in this regard are based on the one hand on the fact that surfactant compounds of this type can be obtained from renewable vegetable and/or animal raw materials, although on the other hand it is above all the high ecological compatibility of selected components of this type to which crucial significance is attributed. An example of one such class of oleochemical surfactant compounds are the known fatty alcohol sulfates which are prepared by sulfatization of fatty alcohols of vegetable and/or animal origin containing predominantly 10 to 20 carbon atoms in the fatty alcohol molecule and subsequent neutralization to water-soluble salts, more particularly the corresponding alkali metal salts. Of particular practical significance in this regard are the sodium salts of fatty alcohol sulfates which are based on at least predominantly linear fatty alcohols or corresponding fatty alcohol mixtures containing approximately 12 to 18 carbon atoms in the fatty alcohol molecule. Tallow alcohol sulfates (TAS) containing predominantly saturated $C_{16-18}$ residues in the fatty alcohol are already of considerable interest for the production of laundry detergents, more particularly in solid form, although significant detergent properties may also be attributed to fatty alcohol sulfates (FAS) which cover a broader range in regard to the length of their carbon chains. Thus, $C_{12-18}$ fatty alcohol sulfates having a high percentage content of the lower fatty alcohols of this range, for example based on coconut oil or palm kernel oil, represent particularly important anionic surfactants for use in detergents and cleaning products. There are numerous references to this effect in the relevant specialist literature, cf. H. Baumann "Neuere Entwicklungen auf dem Gebiet fettchemischer Tenside", Fat Sci. Technol., 92 (1990) 49/50 and the literature cited therein. European patent application 342 917 also describes detergents in which the anionic surfactants consist predominantly of $C_{12-18}$ alkyl sulfates.

The economic synthesis of light-colored anionic surfactants based on FAS is now established state of the art. The corresponding surfactant salts accumulate in the form of water-containing preparations in which the water contents may vary from approximately 20 to 80% and, more particularly, from approximately 35 to 60%. Products of this type have a paste-like to cuttable consistency at room temperature, the flowability and pumpability of the pastes being limited or even completely lost for active substance contents of only about 35% by weight, so that the subsequent processing of the pastes, particularly their incorporation in solids mixtures, for example in solid detergents and cleaning products, involves considerable problems. It is possible to obtain free-flowing FAS powders by conventional drying processes, particularly in spray drying towers. However, there are serious limitations in this regard which, in particular, jeopardize the economy of using FAS surfactants on an industrial scale. Tower-dried TAS powder, for example, shows a very low apparent density, so that there are unprofitable aspects to the packaging and marketing of this detergent raw material. However, even in the production of spray-dried powder, safety considerations can necessitate such restrictive operation of the spray drying tower that practical difficulties arise. Thus, safety-based investigations of tower-dried powder based on TAS or FAS having active substance contents of 20% or higher show that the spray drying of formulations of this type is only possible to a very limited extent and, for example, requires tower entry temperatures below 200° C.

Comparable difficulties or other difficulties are involved in the conversion of water-containing, more particularly paste-form, preparations of numerous other washing- and cleaning-active surfactant compounds into storable dry products. Further examples of anionic oleo-chemical surfactant compounds include the known sulfofatty acid methyl esters (fatty acid methyl ester sulfonates, MES) which are prepared by α-sulfonation of the methyl esters of fatty acids of vegetable and/or animal origin containing predominantly 10 to 20 carbon atoms in the fatty acid molecule and subsequent neutralization to water-soluble monosalts, more particularly the corresponding alkali salts. The corresponding α-sulfofatty acids or disalts thereof are formed therefrom by ester cleavage and show specific washing- and cleaning-active properties in the same way as mixtures of disalts and sulfofatty acid methyl ester monosalts. However, comparable problems also arise with other classes of surfactants where attempts are made to produce the corresponding surfactant raw materials in solid or granular form, as for example with washing- and cleaning-active alkyl glycoside compounds. To obtain light-colored reaction products, their synthesis generally requires a final bleaching step carried out, for example, with water-containing hydrogen peroxide, so that in this case, too, modern technology leads to the water-containing paste form of the surfactant. Water-containing alkyl glycoside pastes (APG pastes) are more susceptible, for example, to hydrolysis or microbial contamination than corresponding solids. In their case, too, simple drying by conventional methods involves significant difficulties. Finally, however, even the drying of a water-containing paste of the alkali metal salts of washing-active soaps and/or of alkyl benzenesulfonates (ABS pastes) can also involve considerable problems.

It is also desirable, above all for economic reasons, to limit the quantity of water to be introduced into the process as far as possible. Accordingly, the smallest possible quantity of water is best used in the water-containing surfactant pastes. However, the degree of concentration is limited by the viscosity behavior of the water-containing pastes. Only raw materials which can still be processed, i.e. for example are flowable and pumpable, in the process can be introduced into the process. It is known that, particularly for detergents and cleaning products, for example for laundry detergents, important anionic surfactants, such as the alkali metal salts of ABS, fatty alcohol sulfates, fatty acids, α-sulfonated fatty acids and corresponding α-sulfofatty acid esters, can only be worked up into flowable and pumpable pastes using relatively considerable quantities of water. Thus, ABS salt pastes and pastes of tallow alcohol sulfates having water contents of 40 to 60% by weight are being processed in practice at the present time. In addition, the paste viscosity of water-containing mixtures of the type in question is still greatly dependent on temperature so that pastes of the type in question cannot be used without difficulties at room temperature and elevated temperatures, for example in the range from 50° to 70° C., have to be applied.

Further investigations in the field in question have revealed dramatic deteriorations in the processability of water-containing mixed pastes in one important special case: the paste viscosity allows ABS and TAS pastes each having solids contents of 50 to 60% by weight to be separately processed. However, if an attempt is made to mix these separately processable pastes to obtain a homogeneous anionic surfactant mixture for subsequent incorporation in detergent formulations, there is a dramatic increase in viscosity in the paste mixture for basically the same solids content. This phenomenon is observed both when the ABS paste is added to the FAS paste and vice versa. Even mixing ratios of 9:1 or 8:2 lead to a solidified, water-containing material which can no longer be processed.

The teaching of U.S. Pat. No. 4,495,092, the entire contents of which are incorporated herein by reference, describes the use of $C_{8-40}$ alcohols which are substituted by 1 to 5 hydroxyl groups and/or onto which up to 15 mol ethylene oxide and/or propylene oxide are added per tool alcohol as viscosity regulators for high-viscosity industrial surfactant concentrates of the synthetic anionic surfactant type. Corresponding water-containing pastes of alkyl sulfates, alkylaryl sulfates and α-sulfofatty acid esters having a surfactant content of at least 30% by weight are mentioned in particular. According to this teaching, the addition of the above-mentioned viscosity regulators in quantities of 1 to 15% by weight, based on the quantity of surfactant, leads to viscosities of the particular surfactant concentrate of at most 10,000 mPa.s at 70° C. (Höppler falling ball viscosimeter). Mixtures of saturated and unsaturated fatty alcohols containing up to 8 tool EO and/or PO units are particularly preferred viscosity regulators. The viscosity behavior of water-containing pastes of mixed surfactants and, in particular, the dramatic increase in viscosity when water-containing ABS and TAS pastes are mixed is not discussed in this publication.

The problem addressed by the present invention was to provide an alternative method of processing water-containing, more particularly paste-form, surfactant preparations into dry, more particularly free-flowing and concentrated surfactant granules. The invention is based on the disclosure of U.S. Pat. No. 4,495,042, but extends the principles described therein beyond existing knowledge.

DESCRIPTION OF THE INVENTION

In a first embodiment, therefore, the present invention relates to a process for the production of washing- and cleaning-active granules by granulation of a mixture of a water-containing surfactant preparation and one or more water-soluble and/or water-insoluble solids, so that free-flowing granules are formed. The concentrated surfactant preparations contain alkoxylates of monohydric and/or polyhydric $C_{8-40}$ alcohols containing up to 20 ethylene oxide and/or propylene oxide groups as viscosity regulators. The free-flowing granules are at least partly freed from their water content by drying.

The process according to the invention is particularly suitable for the granulation of surfactant pastes of which the surfactant components are solids at temperatures of up to at least 40° C. and which per se have a high viscosity, their viscosity being reduced in accordance with the invention by the use of the viscosity regulators. It is thus possible at the same time to reduce the processing temperature and/or to reduce the surfactant solids content in the water-containing paste material. The new process is particularly suitable for the use of anionic surfactant pastes based on alkyl sulfates, alkyl sulfonates, alkylaryl sulfonates, α-sulfofatty acid esters, α-sulfofatty acid disalts and/or soaps. More particularly, it has surprisingly been found that mixed pastes of the type in question, which for example contain mixtures of surfactant compounds based on ABS and TAS in any quantities, can be converted into comparatively free-flowing and pumpable pastes by addition of relatively limited quantities of fatty alcohol alkoxylates. According to the invention, suitable viscosity regulators are, in particular, alkoxylates of fatty alcohols of synthetic and/or natural origin of the type typically used as so-called nonionic surfactant components in modern detergents and cleaning products, particularly laundry detergents, where they are generally used in the form of a mixture with anionic surfactants of the type described above. However, the process according to the invention is also suitable for the use of water-containing pastes of washing-active alkyl glycoside compounds.

The invention thus provides for the economic production of virtually any mixtures of, for example, anionic surfactants and selected nonionic surfactants in dry form which can be controlled and optimized in regard to their composition, i.e. in regard to type and/or quantity, by the particular application envisaged. On the other hand, the interaction between the nonionic surfactants and the water-containing anionic surfactant pastes it is specifically used to control and reduce the viscosity of the raw materials. According to the invention, it is possible in this regard to use these advantages on the one hand to obtain compounds of high surfactant content in the form of dry, free-flowing granules and, on the other hand, to make the technology according to the invention of mixing, granulation and subsequent drying available for the production of detergents and cleaning products, particularly laundry detergents, as a whole or at least in the form of such a premix containing the main components that subsequent further mixing with selected, for example particularly temperature-sensitive, components is all that is necessary to obtain the final laundry detergent.

Accordingly, in another embodiment based on the granulation process described above, the invention relates to a process for the production of highly concentrated surfactant granules which may be used as surfactant-rich compounds for the production of detergents and cleaning products.

In another embodiment, the invention relates to a process for the production of storable and free-flowing detergents and cleaning preparations, more particularly laundry detergents, which are also suitable for subsequent mixing with, in particular, temperature-sensitive constituents of the detergents and cleaning products.

The compounds preferably used as viscosity regulators in accordance with the present invention are derived from monohydric alcohols of natural or synthetic origin having carbon chain lengths in the above-mentioned range. Aliphatic alcohols of this type are known to be derived from natural fats and oils and are obtained, for example, by reduction of the corresponding fatty acid esters. These so-called fatty alcohols are linear and may be saturated or unsaturated. Viscosity regulators based on alkoxylated fatty alcohol mixtures of the type used as nonionic surfactant components in the production of detergents and cleaning preparations are particularly suitable for the purposes of the invention. Accordingly, suitable viscosity regulators are, in particular, ethoxylates of linear and/or branched monofunctional fatty alcohols containing approximately 10 to 20 carbon atoms, particular significance being attributed to the range of 12 to 18 carbon atoms in the alcohol components of the fatty alcohol or fatty alcohol mixture. In one preferred embodiment, these fatty alcohols are alkoxylated with, on average, approximately 2 to 10 EO groups, particular significance again being attributed to the range from about 3 to 8 EO groups. A commercially available nonionic surfactant component of this type is, for example, the product marketed by applicants under the name "Dehydol LST 80:20" which is a mixture of 80 parts by weight $C_{12-18}$ fatty alcohols containing on average 5 EO units and 20 parts by weight of a $C_{12/14}$ fatty alcohol containing 3 EO units. This nonionic surfactant, which is used in numerous laundry detergents, is an extremely useful viscosity regulator for the purposes of the invention. However, alcohol components having a branched carbon chain may also be used as aliphatic alcohols or adducts suitable as viscosity regulators. Examples of alcohols having a branched carbon chain are oxo alcohols and Guerbet alcohols, i.e. alcohols branched in the 2-position obtained by oxo synthesis or by the so-called Guerbet reaction. Polyfunctional alcohols and alkoxylates thereof which are also suitable for the purposes of the invention are mentioned in U.S. Pat. No. 4,495,092 where such compounds as 12-hydroxystearyl alcohol, 9,10-dihydroxystearyl alcohol and ethylene oxide products thereof are named by way of example as the basic alcohol component.

It has been found that an effective improvement in the flowability of water-containing anionic surfactant pastes can be obtained even with only small additions of the nonionic surfactant according to the teaching of U.S. Pat. No. 4,495,092, not only is this the case with selected individual anionic surfactants or water-containing pastes thereof, instead even a few percent of the nonionic surfactant added to a completely solidified ABS/TAS paste guarantees the required flowability and pumpability. In a preferred embodiment of the invention, therefore, the viscosity regulators are used in quantities of at least about 2% by weight and preferably in quantities of at least about 5% by weight, based on the solid weight of the generally anionic surfactant component of the mixture in the water-containing preparation. Quantities of the nonionic viscosity regulators of up to about 15% by weight can be particularly useful, so that particular significance is attributed to the range of about 5 to 15% by weight.

The invention described in detail in the following reference by way of example to the conversion of water-containing FAS pastes into free-flowing granules. The measures and process parameters described in detail hereinafter may also be broadly applied on the basis of general chemical knowledge to other water-containing, more particularly paste-form, surfactant preparations of the type in question here.

The water-containing FAS mixtures used in the flowable and pumpable surfactant preparations are reaction products from the sulfatization and subsequent water-containing/alkaline neutralization of the particular fatty alcohol used. The mixtures in question are generally mixtures of corresponding FAS types having different chain lengths with a preferably linear fatty alcohol radical within the $C_{12-18}$ range mentioned. The water content of these FAS mixtures is preferably in the range from about 20 to 80% by weight and, more preferably, in the range from about 30 to 50% by weight. The preferred working temperature (temperature of the surfactant paste) is either room temperature or a moderately elevated temperature, for example in the range from 40° to 60° C. The granulation process is carried out as follows:

In a suitable mixing and granulating machine, for example in an Eirich mixer, a Lödige mixer (for example a Lödige ploughshare mixer) or a Schugi mixer, the water-containing FAS nonionic surfactant mixture on the one hand and water-soluble and/or water-insoluble solids on the other hand are introduced and mixed with one another at peripheral speeds of the mixing elements of preferably 2 to 7 m/s (ploughshare mixer) or 5 to 50 m/s (Eirich, Schugi) and, more preferably, 15 to 40 m/s in such quantities and with such intensity that free-flowing granules are formed. The grain size of the granules may be determined in advance in known manner. The mixing process requires only a very short time, for example of about 0.5 to 10 minutes and, more particularly, about 0.5 to 5 minutes (Eirich mixer, Lödige mixer), to homogenize the mixture and to form the free-flowing granules. By contrast, where a Schugl mixer is used, a residence time of 0.5 to 10 seconds is normally sufficient to obtain free-flowing granules. The ratios in which the components are mixed and, more particularly, the quantities of solid added have to be adapted to the quantity of water introduced through the FAS mixture in such a way that the homogenized mixture of water-containing surfactant preparation and added solid is able to form the free-flowing granules. The quantity of solid required is normally larger, the higher the water content of the surfactant mixture. However, the free-flowing granules initially formed are not required to show prolonged stability in storage. According to the invention, the granules are preferably transferred to the drying stage while they are still moist, i.e. immediately after granulation. In the preferred embodiment of the invention, drying is carried out in a fluidized bed. Basically, however, there is no need for any subsequent drying step to produce the free-flowing granules. However, drying is advantageous and therefore preferred because surfactant granules of increased surfactant content are obtained in this way. It may be necessary, particularly where surfactant mixtures of low concentration, for example containing more than 50% by weight and, in particular, more than 60% by weight water, are used to dry the granules initially formed to obtain the preferred minimum content of 20% by weight surfactant in the granules. Drying may be carried out to the particular final content of unbound or even bound water in the granules.

In another preferred embodiment, undried granules are mixed in any ratio with partly or completely dried granules. "Completely dried" is understood to be the state in which the unbound water and any bound water remaining have been removed from the granules.

Fluidized-bed drying is a preferred method of drying because it provides for rapid drying of the outer surface of the granules with intensive movement and mixing of the granules, thus counteracting undesirable agglomeration of the still moist granules.

In one particular embodiment, it is possible in the described mixing and granulation stage to produce granules with such a degree of tackiness that, basically, the granules might be expected to stick to one another so firmly that they could not be separated in the immediately following drying stage. According to the invention, the still moist granules accumulating are powdered with a dust-fine or powder-form auxiliary—best immediately after their production—and the granules thus intermediately stabilized are introduced into the drying stage where the state of free-flow of the granules is then rapidly achieved, even under comparatively mild drying conditions.

Drying and, in particular, fluidized-bed drying is preferably carried out at temperatures of the gas phase below 200° C. and, more preferably, at temperatures in the range from about 70° to 160° C., for example at temperatures in the range from about 90° to 150° C. These temperatures apply primarily to the gas phase. In one preferred embodiment, the final temperature of the granules is comparatively low and, for example, does not exceed 80° to 90° C. and, preferably, is no higher than 75° C.

The solids used in the granulation stage for partly drying the water-containing surfactant preparation may be corresponding ingredients from typical formulations of detergents and/or cleaning products, although they may also be foreign substances providing they are compatible with the application envisaged for the surfactants. It will be generally be preferred to use ingredients of detergents and/or cleaning preparations. One particular advantage of the process according to the invention is that there is very considerable freedom in regard to the choice of these solid mixture components. The reason for this lies in the fact that the granulation process according to the invention with the preferably following drying stage is carried out under such comparatively mild conditions that only in exceptional cases is there any danger of unwanted secondary reactions in the granulation and/or drying step. General specialist knowledge may be applied in this regard. Thus, particularly temperature-sensitive mixture constituents, for example of laundry detergents, of the type used for example as bleaches of the perborate type, will have relatively little significance. Preference will be attributed instead to water-soluble and/or water-insoluble solids which can be safely mixed with the water-containing surfactant preparations, granulated and subsequently dried under the described working conditions. Accordingly, typical examples of suitable water-soluble solids are inorganic salts, for example soda, alkali metal silicates, more particularly waterglass powder, sodium sulfate and/or phosphate salts, such as sodium pyrophosphate and sodium tripolyphosphate.

However, in addition to or instead of the use of water-soluble solids in the granulation stage, the teaching according to the invention also encompasses the use of corresponding insoluble, preferably fine-particle materials. The particle size of the preferred solids is less than 1 mm and, more particularly, less than 100 μm, for example no more than 30 μm. Typical examples from the field of detergents and/or cleaning products are additives of the type used as so-called builders for binding alkaline earth metal ions and hence for eliminating water hardness. Examples are fine-particle crystalline zeolites, more particularly sodium zeolite NaA in detergent quality, of which at least 80% preferably consists of particles smaller than 10 μm in size (volume distribution: Coulter Counter). Other examples of preferred solids are hydrotalcites, water-insoluble and crystalline layer silicates, abrasives, such as mineral powders and the like.

One particular aspect of the invention is the use of preferably dried and finely redivided granules from the production line as a solid mixture constituent for working up further quantities of the water-containing surfactant preparations. This embodiment of the invention is characterized in particular by complete or partial recycling of the granules produced by the process according to the invention, more particularly the dried granules. Details of this particular embodiment are given in the following.

For the particular mixing ratios between the surfactants on the one hand and the solids on the other hand to be used in the mixing and granulation stage, it may be useful to adapt these mixture constituents to the corresponding demand for the components in the detergents and/or cleaning products to be ultimately produced. More particularly, the ratio of anionic surfactants to the fine-particle solids used, for example, in laundry detergents may serve as guides for the composition of the mixture to be granulated. The need to use various solid detergent constituents—again best in adapted ratios to one another—may be derived from such considerations. One such case generally arises when the water content of the water-containing surfactant mixture necessitates the use of such large quantities of dry solids that the quantity of this solid in the granules formed would be disproportionately large for the particular application. This is explained in the following with reference to an example:

The waterglass content of laundry detergents is comparatively small, based on the formulation as a whole, amounting for example to between 2 and 5% by weight. By contrast, it may be desirable to mix in very much larger quantities of anionic surfactant based on fatty alcohol sulfate, for example quantities of 20 to 30% by weight, based on the final detergent as a whole. If an FAS surfactant mixture of relatively high water content were to be used to carry out the process according to the invention, considerably larger quantities of waterglass than would be desirable in the final detergent would have to be mixed in to establish the state of a free-flowing powder in the mixing and granulation stage if waterglass powder were to be used as the sole solid. Accordingly, it is advisable in this case to use other dry detergent constituents, for example soda and/or sodium sulfate.

If, on the other hand, the solids used are of the type present or at least potentially present in large quantities in typical detergent formulations, the desired percentage composition of the granules according to the invention may be linked to the proportional mixture determined in advance by the overall detergent formulation. Typical examples of this are mixtures of the water-containing surfactant pastes containing sodium zeolite, soda and/or sodium sulfate.

One particularly important embodiment of the invention is characterized by the above-mentioned partial or complete recycling of the granules, preferably the dried granules, to the mixing and granulation stage. In one preferred embodiment, which is particularly suitable for continuous operation, the entire solid phase added in the mixing and granulation stage is formed from recycled material which consists of already dried granules and which, therefore, already contains considerable quantities of anionic surfactant, i.e. preferably more than 25% by weight, based on the dried granules used as the solid. The dried granules used as solid in the mixing and granulation stage are first size-reduced, for example under the effect of the mixing tools or in a standard mill. The granules may be recycled once or even several times, for example 2 to 8 times. The advantages of recycling are quite clear. In the process according to the invention, surfactant is concentrated in the granules to a fixed, predetermined level. By virtue of the comparatively low melting points of important detergent-quality surfactants, for example FAS compounds and, more particularly, corresponding FAS mixtures, the enrichment of the granules to approximately 100% surfactant (sum of anionic surfactant and nonionic surfactant) will be of relatively little significance in practice. In this embodiment of the process, however, considerably higher surfactant contents can be adjusted in the granules than in the embodiment where the water-containing mixture is passed only once through the mixing and granulation zone. In the embodiment where the granules are recycled, FAS contents of at least 30% by weight and, preferably, at least 35% by weight can readily be established in the granules. It is possible in accordance with the invention to increase the corresponding surfactant content to at least 45% by weight or even to at least 50% by weight. A surfactant content of 30 to 75% by weight, based on the dry granules, is particularly desirable. The higher the surfactant content of the granules, the stronger the tendency of the mixture to soften under the conditions of fluidized-bed drying. The above-mentioned powdering with solid dry mixture components, for example with dried zeolite NaA of detergent quality, can be particularly useful in this regard.

The particle size range of the granules formed and the average particle size are adjusted in known manner by adaptation of the working conditions in the granulation stage. According to the invention, granules having particle sizes in the range from about 0.01 to 3 mm (sieve analysis) and, more particularly, in the range from about 0.05 to 2 mm can be produced without difficulty. In one important embodiment of the invention, the dried granules are graded by removal of unwanted fine and oversize particles in known manner. In another important embodiment of the invention, the fractions thus removed may be returned to the mixing and granulation stage and used as the solid, even when it is not intended to recycle the granulated and dried granules.

The physical properties of the granules may also be largely predetermined in other ways. Thus, the hardness of the granules and, in particular, their abrasion resistance can be modified, for example increased, for example by using suitable auxiliaries, for example small quantities of polymer compounds of the type typically used in detergents and cleaning products. Examples of such polymer compounds are the polyacrylates and polyacrylate copolymers known as builders which may be used, for example, with relative molecular weights in the range from 30,000 to 100,000. Auxiliaries of this type may be added to the mixture in the actual mixing and granulation stage, although they may also be subsequently applied to the preformed granules before or during the drying stage.

However, the process according to the invention may also be modified in a totally different form and used for the easier production of granules of the described type. According to the invention, it is possible for example not only to introduce water-containing surfactants in the mixing and granulation stage, other desired components of the final detergent and/or cleaning product may be introduced at least partly as water-containing material into this stage of the process. This modification is illustrated by the following example: zeolite NaA is known to accumulate during its production as an water-containing suspension (master batch) which may contain more than 50% by weight water and which is usually spray-dried to a powder-form solid. According to the invention, the zeolite may be introduced into the mixing and granulation stage at least partly in the form of this suspension or even in the form of an incompletely dried product so that it may then be dried in admixture with the surfactant and the dry solids added to form granules. An embodiment such as this can be of particular advantage where it is intended to recycle the dried granules and, in this way, to introduce the component required as solid into the mixing and granulation stage through the desired end product.

Zeolite materials of the last-mentioned type and also other typical auxiliaries of detergents and cleaning products are in turn capable of partly binding water. Examples of auxiliaries of this type are anhydrous soda and anhydrous sodium sulfate which are capable of binding considerable quantities of water in the form of water of crystallization. One embodiment of the invention uses this ability to internally bind water for additional drying (internal drying) of the granules formed in the process according to the invention. However, it has been found in this regard that, where for example water-containing FAS pastes and dehydrated soda or dehydrated sodium sulfate are mixed and granulated in such quantitative ratios that almost all the water of the FAS paste introduced is bound by the crystal binding of this water to soda or sodium sulfate, the granulation process can still be carried out, but the products formed are not entirely satisfactory. Corresponding granules of, for example, soda and FAS paste which are solid and free-flowing at room temperature agglomerate in storage, particularly if they are exposed to slightly elevated temperatures in the meantime. Thus, where solids which bind water of crystallization are used, as in one preferred embodiment of the invention, the water content is reduced to such an extent in the drying step that the bound water present as water of crystallization is at least partly removed. Accordingly, the water contents of the preferred dried granules according to the invention are comparatively low. The unbound water content is preferably below 8% by weight and more particularly below 5% by weight, based on the dried granules. Water bound in crystal form or water bound into the molecular structure can be present in limited quantities in the mixture although the stability of the granules in storage will be higher, the lower the extent to which in particular the water of crystallization content of the end product is also reduced. This embodiment will naturally be of little significance in cases where the surfactant granules are to be rapidly further processed. If the granules are to be marketed as raw materials, greater significance will be attributed to this particular embodiment.

If the preferred small quantities of the nonionic surfactant component of 2 to 15% by weight, based on the solids of the generally anionic surfactant in the surfactant paste, are used to regulate viscosity in the production of the free-flowing granules, mixing ratios of anionic to nonionic surfactant that are comparatively low in nonionic surfactants compared with typical formulations of detergents and cleaning products will be present in the final granules. Although this may be of no significance to the teaching according to the invention of improved production of the surfactant granules in question, it must be taken into account when the granules are mixed to form the final detergent or cleaning product. The use of these comparatively small quantities of nonionic surfactant may even be a preferred embodiment of the process according to the invention. This is generally the case when the processing conditions selected for the granulation and the preferably subsequent drying of the granules on the one hand and the volatility of the nonionic surfactants used as viscosity regulators on the other hand are likely to prompt objections on the grounds of so-called pluming which occurs in the towers used for the spray-drying of active-substance mixtures containing nonionic surfactant. However, it is important in this regard to bear in mind the fact that the processing conditions and, in particular, the drying temperatures for the granulation process according to the invention are comparatively mild in the context of the teaching of the earlier application cited at the beginning, so that objections of the type just mentioned are minimized from the outset in this case.

In addition, the invention opens up new possibilities for carrying out the granulation process and, more particularly, the following drying stage. The effective reduction of viscosity in accordance with the invention provides for such low processing temperatures for the granulation stage (for example in the range from 20° to 40° C.) that objections based on the potentional volatility of the nonionic surfactant mixture component would have no foundation. The preferably following drying step may also be carried out at the same low temperatures or at least at comparably low temperatures. This is made possible by the application of reduced pressure in the drying stage, the particular working pressures to be applied being adaptable in known manner to the particular process parameters selected.

The above-described possibilities for carrying out the process according to the invention represent another important embodiment of the invention. In this embodiment, the mixing ratio of anionic to nonionic surfactants ultimately required in practice is actually established in the preliminary granulation stage of the process. In other words, the total nonionic surfactant content required as viscosity regulator in the final laundry detergent is introduced into the granules together with the anionic surfactants.

For the reasons explained above, however, it may still be appropriate to limit the nonionic surfactant content, for example to quantities of at most about 80% by weight and, more particularly, less than 50% by weight, based on the total quantity of nonionic surfactant in the laundry detergent. Nevertheless, a quantity of nonionic surfactant exceeding the range of U.S. Pat. No. 4,495,092, and, hence, about 15% by weight (based on anionic surfactant) will still be used as viscosity regulator in the last of the above-described embodiments of the invention. As mentioned above, the particular quantity of nonionic surfactant to be selected will also be determined by the particular objective in question, i.e. whether to produce anionic surfactant granules of high surfactant content or whether to use the process according to the invention the production of detergents as a whole.

The teaching according to the invention enables the granulation process to be carried out with pastes having a very limited water content, even at very low temperatures, i.e. for example in the range from about 20° to 40° C. Accordingly, even temperature-sensitive materials, such as sodium perborate or enzymes or enzyme-containing preparations may now be used as solid granulation aids. By virtue of the fact that granulation can be carried out at such low temperatures, certain temperature-dependent modifications of solid mixture components which bind water of crystallization can be used to facilitate the process. For example, it is known that, at temperatures of up to about 32° C., soda forms the decahydrate which then changes with release of water into the heptahydrate which is stable up to about 35° C. and, finally, changes into the monohydrate under the effect of a further increase in temperature. The same applies to sodium sulfate. Bearing in mind that one of the objects of the granulation process is to achieve the intermediate water-binding solidification of the mixture introduced into the granulation stage, the advantage afforded by the invention of working at very low granulation temperatures immediately becomes clear. Comparatively small quantities of the solid mixture component (in this case soda or sodium sulfate) are required to bind the quantities of water introduced through the water-containing surfactant pastes and hence to facilitate granulation. The increase in temperature in the granules only takes place in a subsequent preferred stage of the process, namely during fluidized-bed drying, where the intermediately bound water of crystallization can be released from the granules without any damage.

However, the invention also affords the following advantage: by virtue of the relatively low surfactant viscosity, relatively fine droplets are produced when the surfactant pastes are sprayed into the mixing and granulation unit. This provides for more uniform distribution of the free-flowing phase. Where high-speed mixers, for example of the Eirich or Schugi type, are used, a fluidized product zone into which the surfactant paste is sprayed is built up in the mixing zone. The intensive shear forces lead to very fine distribution of the relatively free-flowing water-containing surfactant.

The granules according to the invention can have an increased apparent density, more particularly in relation to corresponding spray-dried materials. Typical granules according to the invention normally have an apparent density of at least about 350 g/l and preferably of at least about 500 g/l. Apparent densities of 600 to 800 g/l are particularly preferred.

As mentioned at the beginning, the process according to the invention may be carried out with a broad range of water-containing surfactant mixtures, including in particular mixtures of surfactants which are sufficiently dimensionally stable and solid at room temperature and which are present as water-based pastes containing the surfactants dispersed in the aqueous phase, above all during their production and/or working up. One important example of surfactants such as these are the α-sulfofatty acid methyl ester monosalts and/or the so-called disalts. In their production on an industrial scale, the monosalts of the sulfofatty acid methyl esters (MES) actually accumulate in the form of a mixture with limited quantities of disalts which, as already known, are prepared by partial ester cleavage with formation of the corresponding α-sulfofatty acids or their disalts. The disalt content of these MES-based surfactants is typically below 50 mol. % of the anionic surfactant mixture, for example in the range up to about 30 mol. %. The teaching according to the invention is suitable for application to MES-based surfactant mixtures of the type in question and to corresponding mixtures having relatively high disalt contents up to the pure disalts.

A preferred water-containing MES starting material are the reaction products of relatively high water content from the sulfonation and subsequent water-containing/alkaline neutralization of the particular fatty acid methyl ester. The reaction products in question are generally mixtures of corresponding MES types having different chain lengths with preferably linear $C_{12-18}$ fatty acid residues. The water content of these crude MES products may be from about 20 to 80% by weight and, more particularly, from about 30 to 60% by weight.

Surfactant compounds based on alkyl glycosides and their production, particularly in the form of water-containing bleached pastes, are described in detail, for example, in International patent application WO 90/03977. Surface-active reaction products of this type are another example of the application of the process according to the invention for the production of dry surfactant-based granules. The process according to the invention may be generally used for working up water-containing preparations of surfactant compounds at least substantially solid at room temperature from the class of anionic, nonionic, zwitterionic and/or cationic surfactants, the choice of corresponding surfactant compounds of high ecological compatibility being preferred.

EXAMPLES

Example 1

1.5 kg of a surfactant mixture of 95% by weight Texin ES 68 (a product of Henkel KGaA containing 53% by weight of the sodium monosalt of α-sulfotallow fatty acid methyl ester and 11% by weight of the disodium salt of sulfotallow fatty acid and also 29% by weight water) and 5% by weight of a $C_{12-18}$ fatty alcohol containing 5 ethylene oxide (EO) groups (Dehydol LT5, a product of Henkel KGaA) were granulated with 1.5 kg soda for 3 minutes in a 10 liter Eirich mixer at a peripheral speed of 24 m/s corresponding to a rotational speed of 2,500 r.p.m. (star whirler). The granules were then dried in a fluidized bed (Aeromatik) for 60 minutes at an air entry temperature of 70° C. Free-flowing granules containing 1.5% by weight water for an apparent density of 750 g/l were obtained. The content of washing-active substance (WAS, titratable—Epton method—anionic surfactant content, in the present case: sulfotallow fatty acid methyl ester and disalt content; accuracy±2% by weight) was 34% by weight, the disalt content amounting to 5.5% by weight.

Example 2

1.5 kg of the surfactant mixture mentioned in Example 1 were granulated with 750 g soda for about 1 minute at 25° C. in an Eirich mixer (10 liters, star whirler, 2,500 r.p.m., 24 m/s). The granules were then dried in a fluidized bed (Aeromatik) for 60 minutes at an air entry temperature of 50° C. Free-flowing granules containing approximately 7% by weight water for an apparent density of 590 g/l were obtained. The WAS content of the granules was 49% by weight.

Example 3

150 kg of the surfactant mixture mentioned in Example 1 were granuled with 150 kg soda for 2 minutes in a 300 liter Eirich mixer (star whirler, 700 r.p.m., 18 m/s). The granules were then dried in a fluidized bed (Heinen) for 20 minutes at an air entry temperature of 100° C. Free-flowing granules containing approximately 1% by weight water for an apparent density of 780 g/l were obtained.

Example 4

150 kg/h of a surfactant mixture of 92% by weight Sulfopon T 55 (a product of Henkel KGaA containing approx. 54% by weight tallow alcohol sulfate and approx. 41% by weight water) and 8% by weight Dehydol LT5 were continuously granulated with 180 kg/h soda in a Schugi mixer (26 m/s). The-granules obtained were dried for 10 minutes at 110° C. The WAS content was 28% by weight and the water content 4% by weight for an apparent density of 350 g/l.

Example 5

1.5 kg of a surfactant mixture of 95% by weight Texin ES 68 and 5% by weight of a fatty alcohol containing 7 EO (Dehydol LT7, a product of Henkel KGaA) were mixed with 750 g sodium sulfate and dried as in Example 1. After drying, the granules contained 0.7% by weight water and 53% by weight WAS, including 8% by weight disalt. The apparent density was 650 g/l.

Example 6

1.5 kg of the surfactant mixture mentioned in Example 4 were granulated with 1.5 kg dried sodium zeolite A as in Example 1 and dried for 60 minutes at an air entry temperature of 90° C. The product had a water content below 1% by weight and an apparent density of 600 to 700 g/l (depending on the fine-particle and oversize-particle components).

Example 7

1.5 kg of the surfactant mixture mentioned in Example 4 were mixed with 1.5 kg soda, granulated and dried as described in Example 6. Another 450 g of the surfactant mixture were then applied to the granules formed in an Eirich mixer. The granules with their increased WAS content were again dried in a fluidized bed. This process could be repeated 7 times without the individual granules sticking to one another either in the mixer or in the fluidized bed. The granules had a WAS content of 65% by weight and a water content of less than 1% by weight for an apparent density of 640 g/l.

Example 8

1.5 kg of the surfactant mixture mentioned in Example 4 were granulated with 1.5 kg sodium perborate monohydrate as described in Example 1. The granules were dried in a fluidized bed for 60 minutes at an air entry temperature of 70° C. The granules had a water content of less than 5% by weight for an apparent density of 680 g/l.

Example 9

2.5 kg of the surfactant mixture mentioned in Example 4 were granulated with 1.5 kg of a porous and absorbent detergent additive [containing 71% by weight zeolite NaA and 4% by weight of a copolymeric polyacrylate (Sokalan CP5, a product of BASF), based on anhydrous substance, and 20% by weight water] and dried as described in Example 6. Another 500 g of the surfactant mixture were then applied and the new granules richer in surfactant were again dried. The granules had a WAS content of 49% by weight and a water content of less than 1% by weight for an apparent density of 630 g/l.

Example 10

389 g of a surfactant mixture consisting of 98% by weight of an water-containing tallow alcohol sulfate paste (55% by weight solids content) and 2% by weight of the product "Dehydol LT 7" were applied to 786 g of a "surfactant-free" powder-form detergent having the composition shown below and granulated in the same way as described in Example 6. The product was dried in a fluidized bed for 60 minutes at an air entry temperature of 90° C. The product had an apparent density of 760 g/l, a water content of 4.6% by weight and a WAS content of 21.3% by weight.

| Composition of the "surfactant-free" detergent (in % by weight): | |
|---|---|
| $C_{12-18}$ sodium fatty acid soap | 2.3 |
| Sodium silicate ($Na_2O:SiO_2$ 1:3.3) | 4.7 |
| Sokalan CP5 ® (a product of BASF; copolymer of acrylic acid) | 6.3 |
| Zeolite (based on anhydrous substance) | 32.7 |
| Sodium carbonate, calcined | 18.9 |
| Sodium sulfate | 28.1 |
| Water and other constituents | 7.0 |

What is claimed is:

1. A process for the production of surfactant granules which comprises mixing a water-containing surfactant paste with one or more water soluble or water insoluble solids to directly form granules comprised of at least about 20% by weight of surfactant, wherein said water-containing surfactant paste is comprised of an anionic surfactant or an alkyl glycoside or a combination thereof and a viscosity regulator selected from the group consisting of an ethoxylated or propoxylated $C_{10-20}$ monohydric alcohol having a degree of alkoxylation of up to 20, an ethoxylated or propoxylated $C_{8-40}$ polyhydric alcohol having a degree of alkoxylation of up to 20, and mixtures thereof.

2. The process of claim 1 further comprising the step of drying said granules in a fluidized bed.

3. The process of claim 1 wherein the temperature of the gas phase used in said fluidized bed is less than about 200° C.

4. The process of claim 1 wherein said anionic surfactant is selected from the group consisting of an alkyl sulfate, alkyl sulfonate, α-sulfofatty acid ester, α-sulfofatty acid disalt, and a soap.

5. The process of claim 12 wherein said viscosity regulator is a $C_{10-20}$ monohydric alcohol having a degree of ethoxylation of from about 2 to about 10.

6. The process of claim 5 wherein said degree of ethoxylation is from about 3 to about 8.

7. The process of claim 1 wherein the concentration of said viscosity regulator is at least 2% by weight of said anionic surfactant or said alkyl glycoside or said combination thereof.

8. The process of claim 7 wherein the concentration of said viscosity regulator is at least 5% by weight of said anionic surfactant or said alkyl glycoside or said combination thereof.

9. The process of claim 8 wherein the concentration of said viscosity regulator is from about 5% to about 15% by weight of said anionic surfactant or said alkyl glycoside or said combination thereof.

10. The process of claim 1 wherein said water-soluble solid is soda, an alkali metal silicate, or sodium sulfate.

11. The process of claim 1 wherein said water-insoluble solid is zeolite NaA, hydrotalcite, mineral powder, or crystalline layer silicate.

12. The process of claim 1 wherein said granules have a surfactant content of at least 25% by weight of dry granules.

13. The process of claim 12 wherein said granules have a surfactant content of from about 30% to about 75% by weight of dry granules.

14. The process of claim 1 wherein said granules are comprised of an anionic surfactant which is a solid at a temperature of at least room temperature.

15. The process of claim 14 wherein said granules are comprised of an anionic surfactant which is a solid at a temperature of about 40° C.

* * * * *